US005380639A

United States Patent [19]

Ishige et al.

[11] Patent Number: 5,380,639

[45] Date of Patent: * Jan. 10, 1995

[54] SILVER HALIDE COLOR PHOTOGRAPHIC MATERIAL

[75] Inventors: Osamu Ishige; Eisaku Katoh; Hiroko Fujiwara; Shigeto Hirabayashi; Shuichi Sugita, all of Hino, Japan

[73] Assignee: Konica Corporation, Tokyo, Japan

[ * ] Notice: The portion of the term of this patent subsequent to Dec. 14, 2010 has been disclaimed.

[21] Appl. No.: 925,011

[22] Filed: Aug. 5, 1992

[30] Foreign Application Priority Data

Aug. 23, 1991 [JP] Japan ..... 3-211905

[51] Int. Cl.[6] ..... G03C 1/08; G03C 7/26; G03C 7/32

[52] U.S. Cl. ..... 430/544; 430/505; 430/557; 430/957

[58] Field of Search ..... 430/957, 544, 557, 505

[56] References Cited

U.S. PATENT DOCUMENTS

| | | | |
|---|---|---|---|
| 3,148,062 | 9/1964 | Whitmore et al. | 430/382 |
| 3,227,554 | 1/1966 | Barr et al. | 430/382 |
| 3,620,747 | 11/1971 | Marchant et al. | 430/505 |
| 3,674,490 | 7/1972 | Matejec | 430/376 |
| 3,703,375 | 11/1972 | Groet et al. | 430/505 |
| 3,822,129 | 7/1974 | Dunn et al. | 430/373 |
| 3,834,907 | 9/1974 | Bissonette | 430/505 |
| 3,841,873 | 10/1974 | Mowrey et al. | 430/373 |
| 3,847,619 | 11/1974 | Bissonette et al. | 430/504 |
| 3,862,842 | 1/1975 | Bissonette | 430/241 |
| 3,923,511 | 12/1975 | Bissonette | 430/241 |
| 4,146,396 | 3/1979 | Yokota et al. | 430/385 |
| 4,248,962 | 2/1981 | Lau | 430/557 |
| 4,409,232 | 10/1983 | Cohnen | 424/272 |
| 4,421,845 | 12/1983 | Uemura et al. | 430/544 |
| 4,546,073 | 10/1985 | Bergthaller et al. | 430/543 |
| 4,652,516 | 3/1987 | Ichijima et al. | 430/544 |
| 4,678,735 | 7/1987 | Kitaguchi et al. | |
| 4,698,297 | 10/1987 | Ichijima et al. | 430/383 |
| 4,992,360 | 2/1991 | Tsuruta et al. | 430/557 |
| 5,021,322 | 6/1991 | Begley et al. | 430/957 |
| 5,021,331 | 6/1991 | Vetter et al. | 430/957 |
| 5,091,294 | 2/1992 | Nishijima et al. | 430/557 |
| 5,270,156 | 12/1993 | Hirabayashi et al. | 430/505 |

FOREIGN PATENT DOCUMENTS

| | | |
|---|---|---|
| 0299726A2 | 1/1989 | European Pat. Off. |
| 0371767A3 | 6/1990 | European Pat. Off. |
| 0384670A3 | 8/1990 | European Pat. Off. |
| 0422513A3 | 4/1991 | European Pat. Off. |
| 54-145135 | 11/1979 | Japan |
| 56-114946 | 9/1981 | Japan |
| 2072363A | 9/1981 | United Kingdom |

*Primary Examiner*—Janet C. Baxter
*Assistant Examiner*—Geraldine Letscher
*Attorney, Agent, or Firm*—Finnegan, Henderson, Farabow, Garrett & Dunner

[57] ABSTRACT

A silver halide color photographic material containing a compound capable of the timed release of photographically useful groups is disclosed. The material contains at least one compound of the formula (I):

(I)

wherein $R_1$ is an alkyl group; $R_2$ is an alkyl or aryl group; $R_3$ is an oxycarbonyl, sulfonamido, carbamoyl, acylamino, ureido, oxycarbonylamino, sulfonyloxy, carbonyloxy or sulfamoyl group; $R_4$ is a substituent; n is 0, 1, 2 or 3; and X is a group, preferably of the formula (II) or (III), which, when eliminated upon coupling with the oxidation product of a developing agent, forms an o-quinonemethide or p-quinonemethide to release a development inhibitor or a precursor thereof.

5 Claims, No Drawings

SILVER HALIDE COLOR PHOTOGRAPHIC MATERIAL

BACKGROUND OF THE INVENTION

This invention relates to a silver halide color photographic material containing a novel photographic, compound that is capable of timed release of photographically useful groups. More particularly, this invention relates to a silver halide color photographic material having smooth gradation from the high- to the low-exposure range.

Various methods are known as means for achieving imagewise release of photographically useful groups by making use of compounds that are to be put to photographic use. See, for example, U.S. Pat. No. 8,148,062 to Whitmore et al. and U.S. Pat. No. 3,227,554 to Bart et al., which disclose a method of reacting a photographic coupler with an oxidized color developer so that a development inhibitor or a dye is released from the coupling site of the coupler. This prior art method and the compounds used are classified as a technique for causing photographically useful groups to be directly released from those compounds. However, this direct release approach is not suitable for use in certain eases that need various adjustments; for instance, the release time of photographically useful groups may have to be accelerated or retarded in consideration of various reactions that are caused by other materials in the photographic material; alternatively, photographically useful groups may have to be shifted by a certain distance in order to insure that they will exhibit their intended effects in a predetermined constituent layer or position in the photographic material. In these cases, considerable difficulty is involved in achieving the necessary adjustments by the direct release method. If one wants to solve this problem by the prior art technology, it is necessary not only to select appropriate components that release photographically useful groups but also review means for coupling photographically useful groups to the selected components. In addition, the photographically useful groups per se must be carefully selected. Thus, it is essential to make an extensive review from a broad range of viewpoints but such adjustments are in conflict with the objects or effects that are desirably achieved by the aforementioned components or photographically useful groups. As a result, the degree of freedom in selecting the appropriate components is reduced rather than increased in connection with the intended objects.

A contrastive approach, or a method of releasing photographically useful groups indirectly, is described in Unexamined Published Japanese Patent Application No. 145135/1979, U.S. Pat. No. 4,284,962 and European Patent No. 299,726. According to these patents, the first stage of cleavage is caused by reaction with the oxidation product of a color developing agent and, thereafter, the second stage of cleavage is effected by performing an intramolecular nucleophilic substitution reaction, so that adjustment can be made over a broad range in order to control many parameters including time or distance adjustments of the effects that are to be achieved by the photographically useful groups which are the final end products.

The photographic couplers described specifically in the patents listed above must satisfy the essential requirement that nucleophilic groups be directly coupled to the coupler component but this offers the disadvantage of limiting the degree of freedom in selecting the coupler component and the nucleophilic group. Under the circumstances, it often becomes necessary to use coupler components that are low in coupling performance or the coupler components used may decompose during storage to deteriorate the silver halide photographic material in which they are incorporated.

A method for eliminating these defects has been proposed in Unexamined Published Japanese Patent Application No. 114946/1981; however, the proposal is still unsatisfactory in terms of coupling performance and the effective range of photographically useful materials and there has remained much room for extending the latitude. Common color negative films, as they are loaded in a camera, are used to take pictures of various objects under various conditions; hence, in order to insure that image can be recorded or more image information can be recorded even if the amount of exposure is somewhat deviated from the proper range, it is necessary to design films that have greater latitude. To meet this need, two or more kinds of silver halide emulsions that are sensitive to the same color but in different degrees are used so that image information can be recorded from the high- to low-exposure range. In this case, it is required that the characteristic curve (plotting image density D vs $-\log E$; E is the amount of exposure) be smooth but if the DIR compounds proposed in Unexamined Published Japanese Patent Application No. 114946/1981 are used, it has been difficult to achieve a smooth characteristic curve without lowering the sensitivity in the low-exposure area.

SUMMARY OF THE INVENTION

The present invention has been accomplished under these circumstances and has as an object providing a silver halide color photographic material that is characterized by smooth gradation from the low- to the high-exposure range and which yet suffers from less desensitization.

This object of the present invention can be attained by a silver halide color photographic material that contains at least one compound represented by the following general formula (I):

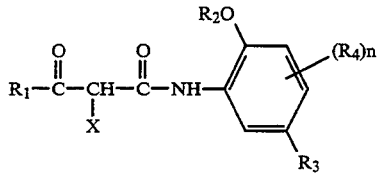

(I)

where $R_1$ is an alkyl group; $R_2$ is an alkyl or aryl group; $R_3$ is an oxycarbonyl, sulfonamido, carbamoyl, acylamino, ureido, oxycarbonylamino, sulfonyloxy, carbonyloxy or sulfamoyl group; $R_4$ is a substituent; n is 0, 1, 2 or 3; and X is a group which, when eliminated upon coupling with the oxidation product of a developing agent, forms an ortho-quinonemethide para-quinonemethide to release a development inhibitor or a precursor thereof.

DETAILED DESCRIPTION OF THE INVENTION

The general formula (I) is described below more specifically. In the general formula (I), the alkyl group represented by $R_1$ may be straight-chained, branched or cyclic; exemplary straight-chained alkyl groups include methyl, ethyl, dodecyl, etc.; exemplary branched alkyl groups include isopropyl, t-butyl, t-octyl, etc.; and exemplary cyclic alkyl groups include cyclopropyl, cyclohexyl, adamantyl, etc. These alkyl groups represented by $R_1$ may have substituents and exemplary substituents include a halogen atom, an aryl group, an alkoxy group, an aryloxy group, an alkylsulfonyl group, an acylamino group, a hydroxyl group, etc. Preferably, $R_1$ is a branched or cyclic alkyl group, with a branched alkyl group, say, t-butyl, being most preferred.

The alkyl group represented by $R_2$ in the general formula (I) may be exemplified by the same groups as listed for $R_1$. Those alkyl groups represented by $R_2$ may have substituents that are the same as those listed for $R_1$. The preferred alkyl group $R_2$ is straight-chained or branched. The aryl group represented by $R_2$ in the general formula (I) may be exemplified by phenyl, naphthyl, etc. These aryl groups represented by $R_2$ may have substituents and exemplary substituents include a halogen atom, an alkyl group, an aryl group, an alkoxy group, an aryloxy group, a nitro group, a cyano group, an acylamino group, etc. The preferred aryl group $R_2$ is substituted or unsubstituted phenyl group. A particularly preferred example of $R_2$ is a straight-chained alkyl group, with methyl being most preferred.

In the general formula (I), $R_3$ represents a non-diffusible ballast group, as specifically exemplified by oxycarbonyl, sulfonamido, carbamoyl, acylamino, ureido, oxycarbonylamino, sulfonyloxy, carbonyloxy and sulfamoyl groups, which may optionally have substituents. Preferred examples of $R_3$ are listed below as identified by respective general formulas A–L:

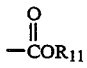
A

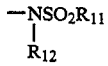
B

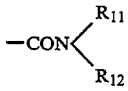
C

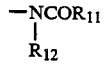
D

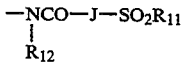
E

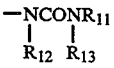
F

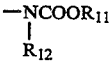
G

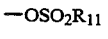
H

J

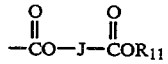
K

-continued

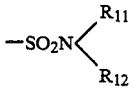
L

In the general formulas A–L, $R_{11}$ represents an alkyl, cycloalkyl or aryl group, and $R_{12}$ and $R_{13}$ each independently represents a hydrogen atom, an alkyl group, a cycloalkyl group or an aryl group. Examples of the alkyl and cycloalkyl groups represented by $R_{11}$, $R_{12}$ and $R_{13}$ include straight-chained or branched alkyl and cycloalkyl groups having 1–30 carbon atoms, such as methyl, n-butyl, cyclohexyl, 2-ethylhexyl, n-dodecyl and n-hexadecyl. Examples of the aryl group represented by $R_{11}$, $R_{12}$ and $R_{13}$ include aryl groups having 6–22 carbon atoms, such as phenyl and 1-naphthyl.

These alkyl, cycloalkyl and aryl groups represented by $R_{11}$, $R_{12}$ and $R_{13}$ may have substituents and exemplary substituents include: a halogen atom (e.g. Cl or Br), a hydroxyl group, an aryl group (e.g. phenyl or 4-t-butylphenyl), an aryloxy group (e.g. phenoxy, p-methylphenoxy or 2,4-di-t-amylphenoxy), an alkoxy group (e.g. methoxy, ethoxy, i-propoxy or n-dodecyloxy), a cycloalkyloxy group (e.g. cyclohexyloxy), an alkylthio group (e.g. methylthio), an alkylsulfonylamino group (e.g. methanesulfonylamino or n-butanesulfonylamino), and an alkylcarbonylamino group (e.g. acetylamino or 3-(2,4-di-t-amylphenoxy) butanoylamino).

Besides these substituents, the aryl groups represented by $R_{11}$, $R_{12}$ and $R_{13}$ may have alkyl groups as substituents.

In general formulas E and K, symbol J denotes a divalent organic linkage group selected from among an alkylene group and an arylene group. Exemplary alkylene groups include straight-chained or branched alkylene groups having 1–10 carbon atoms, such as methylene, ethylene, methylethylene, propylene, dimethylmethylene, butylene, hexylene, etc. Exemplary arylene groups include arylene groups having 6–14 carbon atoms, such as 1,2-phenylene, 1,4-phenylene and 1,4-naphthylene.

The substituent represented by $R_4$ in the general formula (I) may be of any group that can be substituted on the benzene ring and may be exemplified by a halogen atom, an alkyl group, an alkoxy group, an aryloxy group, an acyloxy group, an imido group, an acylamino group, a sulfonamido group, an oxycarbonyl group, a carbamoyl group, a sulfamoyl group, a carbonyloxy group, an oxycarbonylamino group, a ureido group, a sulfonyloxy group, etc.

In the general formula (I), X represents a group which, when eliminated upon coupling with the oxidation product of a developing agent, forms an ortho-quinone methide or para-quinonemethide to release a development inhibitor or a precursor thereof. Preferred examples of such group are those represented by the following general formulas (II) and (III):

(II)

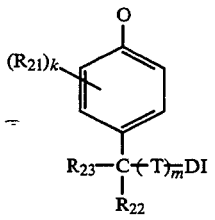

(III)

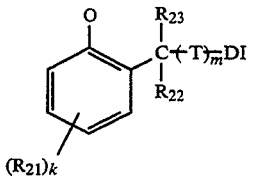

In the general formulas (II) and (III), $R_{21}$ represents a group that can be substituted on the benzene ring and may be exemplified by a halogen atom, an alkyl group, an alkenyl group, an aralkyl group, an alkoxy group, an alkoxycarbonyl group, an anilino group, an acylamino group, a ureido group, a cyano group, a nitro group, a sulfonamido group, a sulfamoyl group, a carbamoyl group, an aryl group, a carboxyl group, a sulfo group, a cycloalkyl group, an a kanesulfonyl group, an arylsulfonyl group, an acyl group, etc. Preferred examples of $R_{21}$ include a nitro group, an acylamino group, a sulfonamido group, a sulfamoyl group, a cyano group, an alkoxycarbonyl group, etc.

In the general formulas (II) and (III), k represents an integer of 0–4, preferably 0, 1 or 2, with 1 being particularly preferred.

In the general formulas (II) and (III), $R_{22}$ and $R_{23}$ each independently represents a hydrogen atom, an alkyl group or an aryl group. The alkyl group may be exemplified by methyl, ethyl, i-propyl, trifluoromethyl, cyclohexyl, dodecyl, etc. The aryl group may be exemplified by phenyl, p-tolyl, p-octylphenyl, naphthyl, etc.

In the general formula (II) and (III), T represents a linkage group as exemplified by: a group that utilizes the cleavage reaction of hemiacetal as described in U.S. Pat. Nos. 4,146,396, 4,652,516 or 4,698,297; a timing group that utilizes an intramolecular nucleophilic reaction to cause a cleavage reaction as described in U.S. Pat. No. 4,248,962; a timing group as described in U.S. Pat. Nos. 4,409,323 and 4,421,845; a group that utilizes the hydrolysis of iminoketal to cause a cleavage reaction as described in U.S. Pat. No. 4,546,073; and a group that utilizes ester hydrolysis to cause a cleavage reaction as described in West German Patent Application (OLS) No. 2,626,317.

In the general formulas (II) and (III), m represents 0 or 1.

In the general formulas (II) and (III), DI represents a development inhibitor and preferred examples include: 5-mercaptotetrazole-base compounds (e.g. 1-phenyl-5-mercaptotetrazole, 1-(4-hydroxyphenyl)-5-mercaptotetrazole, 1-(2-methoxycarbonylphenyl)-5-mercaptotetrazole, 1-ethyl-5-mercaptotetrazole and 1-propyloxycarbonylmethyl-5-mercaptotetrazole); benzotriazole-base compounds (e.g. 5- (or 6-)-nitrobenzotriazole and 5- (or 6-) phenoxycarbonylbenzotriazole); 1,3,4-thiadiazole-base compounds (e.g. 5-methyl-2-mercapto-1,3,4-thiadiazole and 5-(2-methoxycarbonylethylthio)-2-mercapto-1,3,4-thiadiazole); 1,3,4-oxadiazole-base compounds (e.g. 5-methyl-2-mercapto-1,3,4-oxadiazole), benzothiazole-base compounds (e.g. 2-mercaptobenzothiazole); benzimidazole-base compounds (e.g. 2-mercaptobenzimidazole); benzoxazole-base compounds (e.g. 2-mercaptobenzoxazole); and 1,2,4-triazole-base compounds (e.g. 3-(2-furyl)-5-hexylthio-1,2,4-triazole). Preferred DIS are 1,3,4-oxadiazole-base compounds and 5-mercaptotetrazole compounds.

Preferred development inhibitors are those compounds which have substituents that contain bonds capable of intiating a cleavage reaction during development (e.g. an ester bond, a urethane bond, a sulfonate ester bond and a carbonate ester bond).

Typical examples of the compound of formula (I) to be used in the present invention are listed below.

Typical Examples of Compound (I)

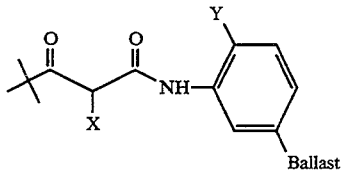

| No. | X | Y | Ballast |
|---|---|---|---|
| (1) | 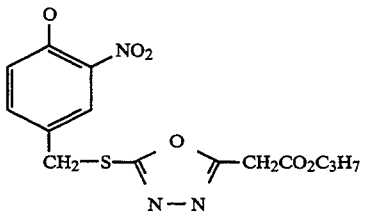 | $OCH_3$ | $NHSO_2C_{16}H_{33}$ |

-continued
Typical Examples of Compound (I)
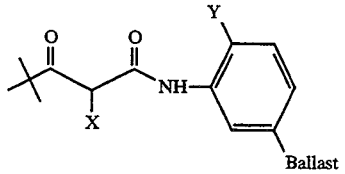
| No. | X | Y | Ballast |
|---|---|---|---|
| (2) | 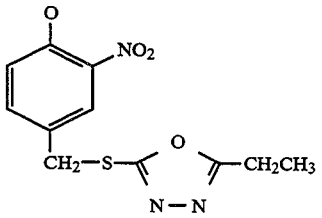 | $OCH_3$ | $NHSO_2C_{16}H_{33}$ |
| (3) | 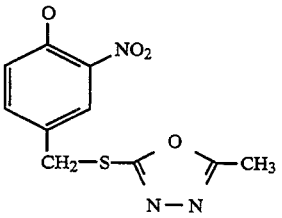 | $OC_2H_5$ | $NHSO_2C_{16}H_{33}$ |
| (4) | 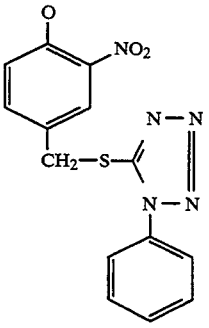 | $OCH_3$ | $NHSO_2C_{16}H_{33}$ |
| (5) | 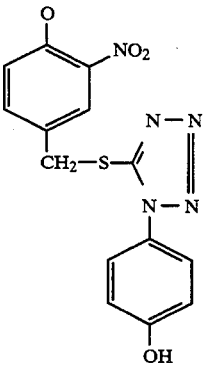 | $OC_3H_7i$ | $NHSO_2C_{16}H_{33}$ |
| (6) | 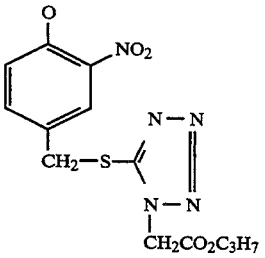 | $OCH_3$ | $NHSO_2C_{16}H_{33}$ |

-continued
Typical Examples of Compound (I)
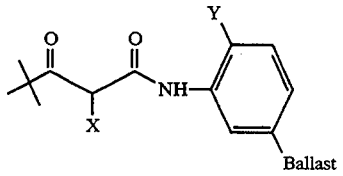
| No. | X | Y | Ballast |
|---|---|---|---|
| (7) | 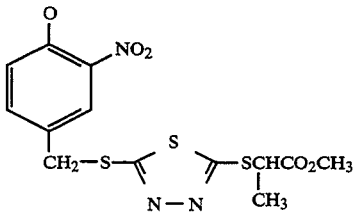 | $OCH_3$ | $NHSO_2C_{12}H_{25}$ |
| (8) | 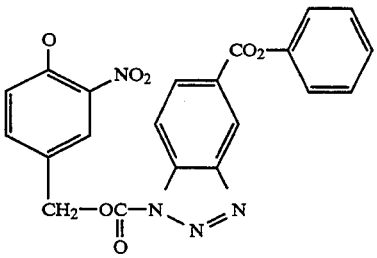 | $OCH_3$ | $NHSO_2C_{12}H_{25}$ |
| (9) | 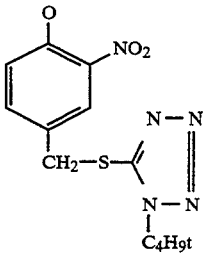 | $OCH_3$ | $NHSO_2C_{16}H_{33}$ |
| (10) | 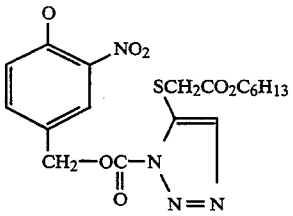 | $OC_3H_7i$ | $NHSO_2C_{16}H_{33}$ |
| (11) | 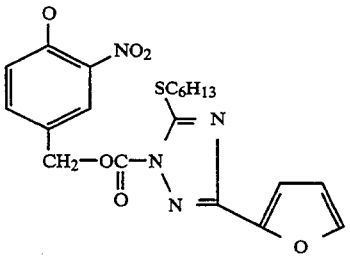 | 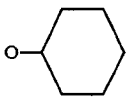 | $NHSO_2C_8H_{17}$ |

-continued
Typical Examples of Compound (I)
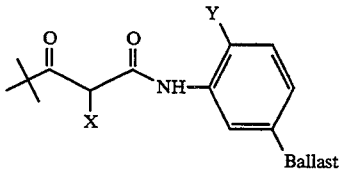
| No. | X | Y | Ballast |
|---|---|---|---|
| (12) | 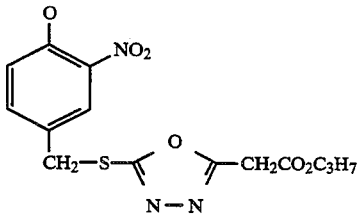 | $OCH_3$ | $NHSO_2C_8H_{17}$ |
| (13) | 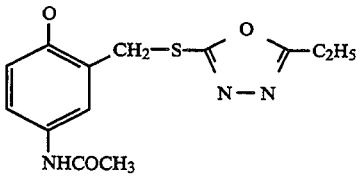 | $OC_2H_5$ | $NHSO_2C_{16}H_{33}$ |
| (14) | 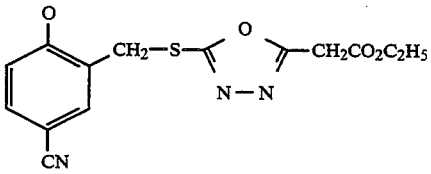 | $OC_4H_{9t}$ | 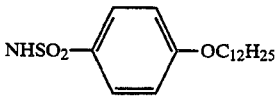 |
| (15) | 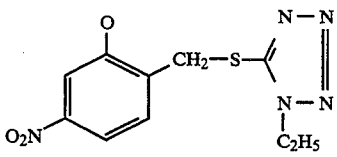 | $OC_2H_5$ | 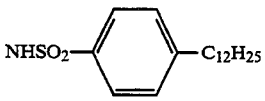 |
| (16) | 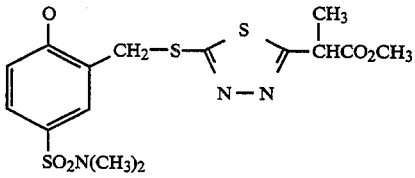 | $OCH_3$ | $NHSO_2C_{16}H_{33}$ |
| (17) | 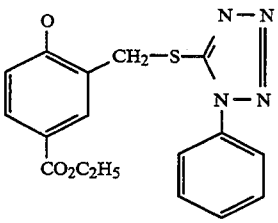 | 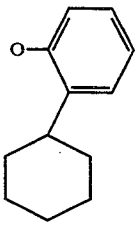 | $NHSO_2C_{18}H_{37}$ |
| (18) | 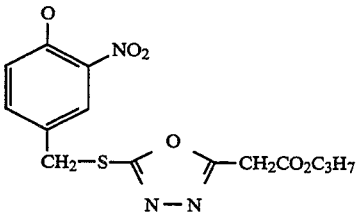 | $OCH_3$ | $CO_2C_{12}H_{25}$ |

-continued
Typical Examples of Compound (I)
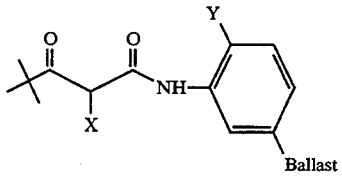
| No. | X | Y | Ballast |
|---|---|---|---|
| (19) | 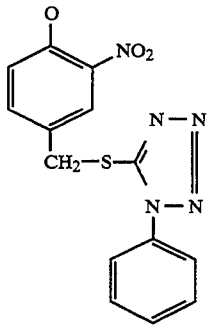 | $OCH_3$ | $CO_2C_{12}H_{25}$ |
| (20) | 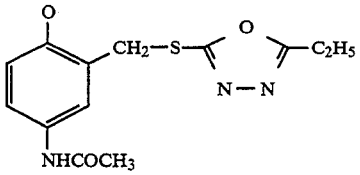 | $OCH_3$ | $CO_2C_{12}H_{25}$ |
| (21) | 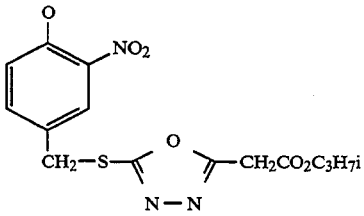 | $OCH_3$ | $CO_2CH(CH_3)CO_2C_{12}H_{25}$ |
| (22) | 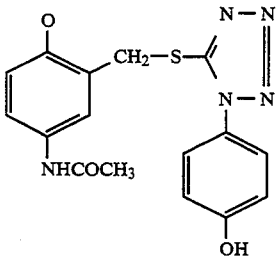 | $OCH_3$ | $CO_2CH_2CO_2C_{12}H_{25}$ |
| (23) | 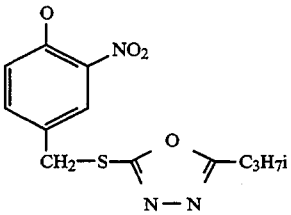 | $OCH_3$ | $NHCOCH(CH_3)CH_2SO_2C_{12}H_{25}$ |
| (24) | 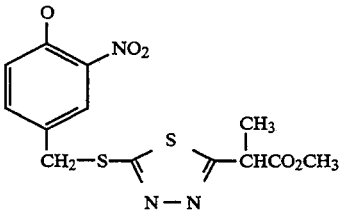 | $OC_6H_{13}$ | 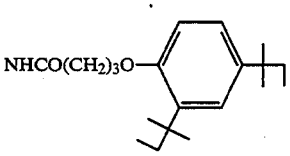 |

-continued
Typical Examples of Compound (I)
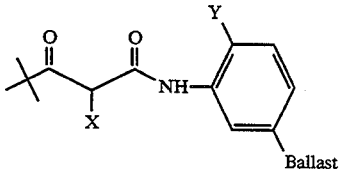
| No. | X | Y | Ballast |
|---|---|---|---|
| (25) | 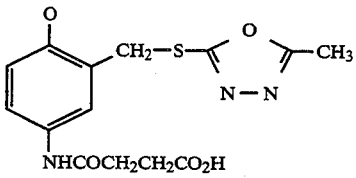 | $OCH_3$ | 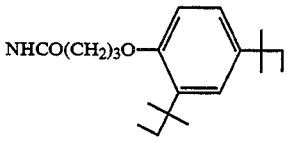 |
| (26) | 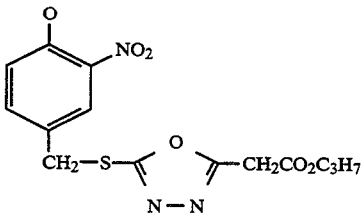 | $OCH_3$ | $SO_2NHC_{14}H_{27}$ |
| (27) | 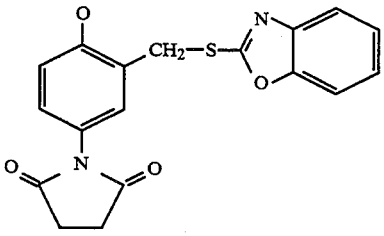 | $OC_{16}H_{33}$ | $SO_2N(CH_3)_2$ |
| (28) | 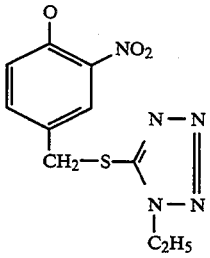 | $OCH_3$ | 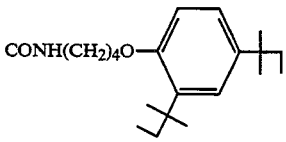 |
| (29) | 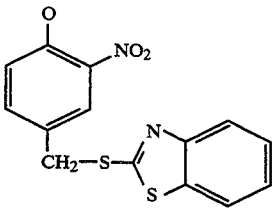 | $OCH_3$ | $NHSO_2C_{16}H_{33}$ |
| (30) | 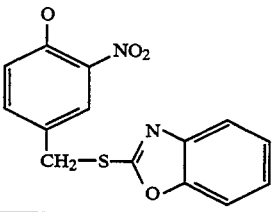 | $OCH_3$ | $NHSO_2C_{16}H_{33}$ |
Synthesis Example 1 (Synthesis of exemplary compound (12)):

Reaction scheme

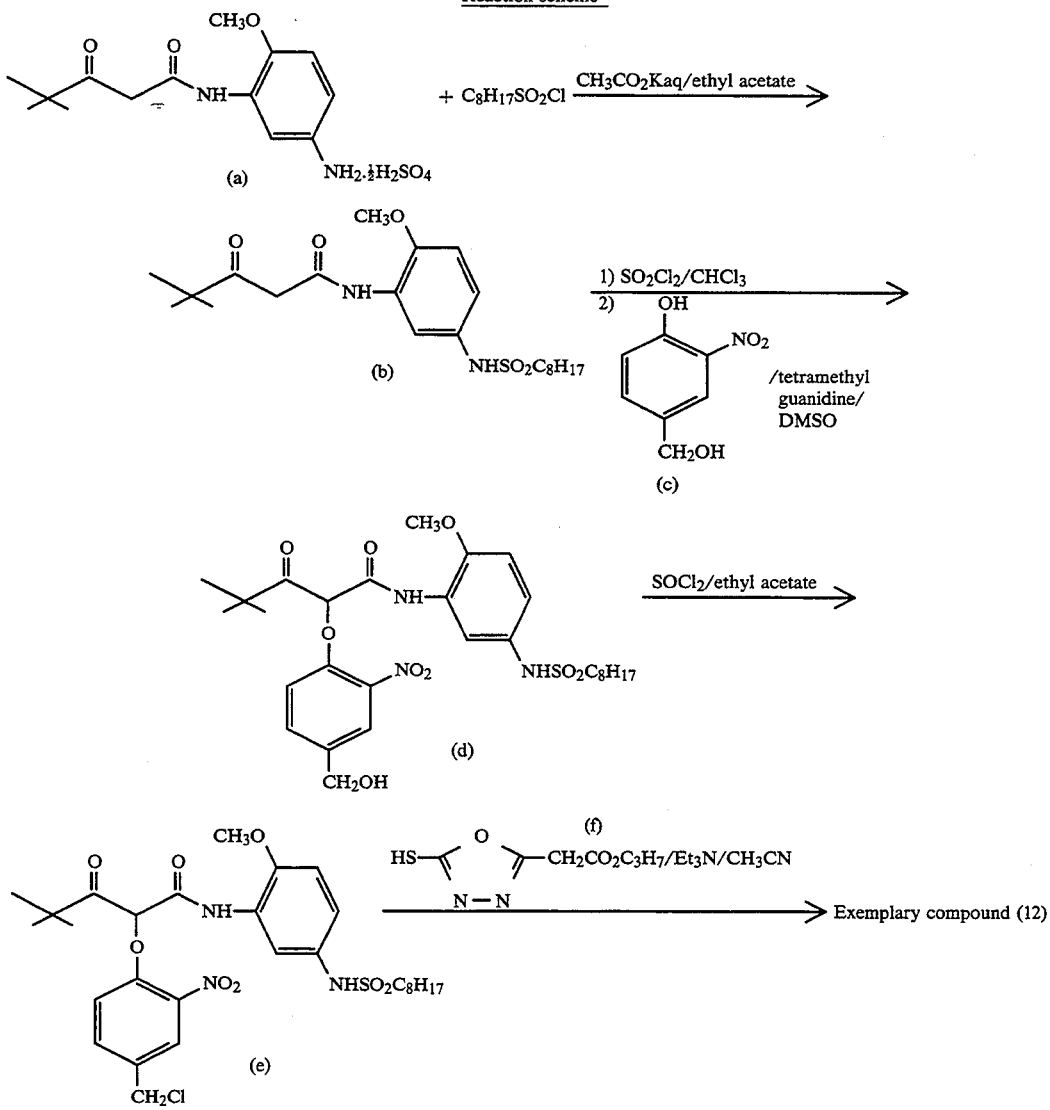

(I) Synthesis of intermediate (b)

Potassium acetate (34.6 g) was dissolved in 300 ml of water. To the solution, 300 ml of ethyl acetate and 31.3 g of compound (a) were added and stirred vigorously at room temperature. To the stirred mixture, 28.4 g of octanesulfonyl chloride was added dropwise and stirring was continued for 7 h at room temperature. After phase separation, the organic layer was washed with an aqueous solution of 5% $NaHCO_3$, then washed with dilute HCl and $H_2O$. After drying on magnesium sulfate, the product was concentrated under vacuum and the resulting residue was recrystallized from an ethyl acetate/hexane solvent system to yield intermediate (b) in an amount of 33.5 g.m.p. 91°-93° C.

(II) Synthesis of intermediate (d)

Intermediate (b) (22.0 g) was dissolved in 110 ml of chloroform and 6.8 g of sulfuryl chloride was added dropwise under agitation at room temperature. After stirring at room temperature for 1 h, the mixture was concentrated under vacuum. The concentrate was dissolved in 200 ml of DMSO and 16.9 g of compound (c) was added to the solution. Subsequently, 11.5 g of tetramethyl guanidine was added dropwise under agitation at room temperature and the reaction was continued for ca. 2 h. After the end of the reaction, water was added and the reaction was extracted with ethyl acetate. The organic layer was washed successively with an aqueous solution of 5% $NaHCO_3$, dilute HCl and water. After drying with magnesium sulfate, the product was concentrated under vacuum and the resulting residue was recrystallized from ethyl acetate to yield intermediate (d) in an amount of 21.4 g.m.p. 130°-134° C.

(III) Synthesis of intermediate (e)

Intermediate (d) (15.2 g) was dissolved in 75 ml of ethyl acetate and 3.9 g of thionyl chloride was added to the solution. The mixture was subjected to continued heating at reflux temperature under stirring for 45 min. Subsequently, the reaction product was concentrated under vacuum and the resulting residue was recrystallized from acetonitrile to yield intermediate (e) in an amount of 10.9 g.m.p. 149°-153° C.

(IV) Synthesis of exemplary compound (12)

Intermediate (e) (6.3 g) and compound (f) (2.8 g) were added to 100 ml of acetonitrile and 2.0 g of ethylamine was added dropwise under stirring at room temperature. After stirring at room temperature for ca. 1 h, the reaction product was heated at reflux temperature for 30 min. After leaving the product to cool, water was added and the mixture was extracted with ethyl acetate. The organic layer was washed successively with an aqueous solution of 5% $NaHCO_3$, dilute HCl and water and dried on magnesium sulfate. The dried product was concentrated under vacuum and the resulting residue was recrystallized from an ethyl acetate/hexane solvent system to yield exemplary compound (12) in an amount of 1.6 g.m.p. 84°-88° C. The structual identity of this compound was verified by NMR and mass spectra.

Synthesis Example 2 (Synthesis of exemplary compound (25)):

Reaction scheme

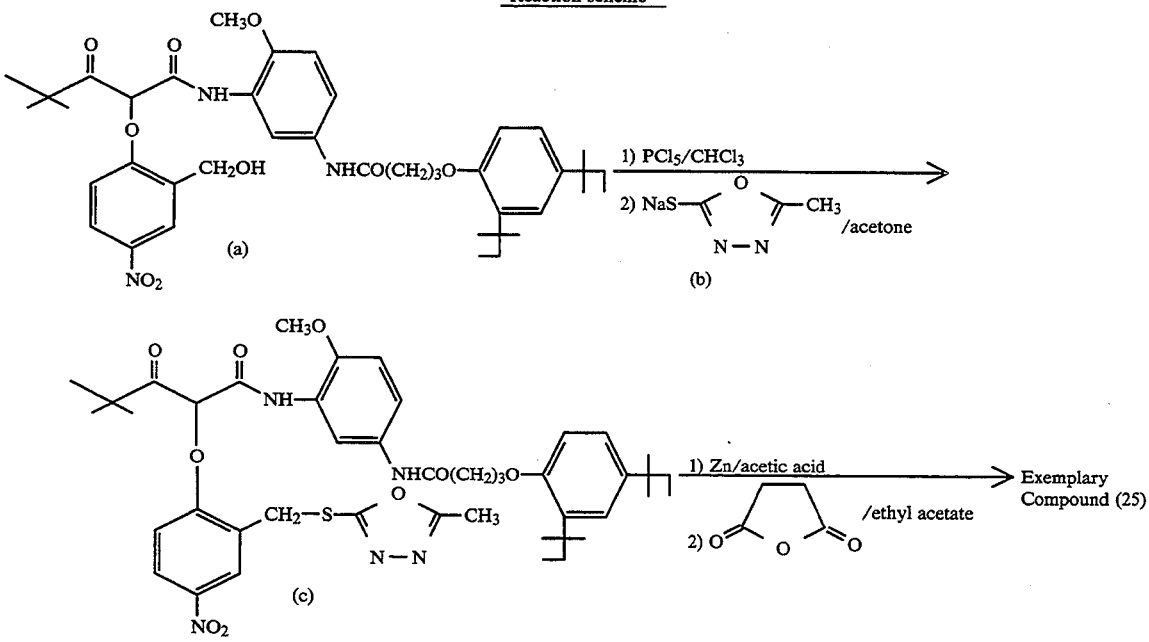

(I) Synthesis of intermediate (c) Compound (a) (14.7 g) synthesized by the same method as in Synthesis Example 1 was dissolved in 150 ml of chloroform. To the solution, 5.0 g of phosphorous pentachloride was added and the mixture was stirred at room temperature for 2 h. Subsequently, the organic layer was washed with water, dried on magnesium sulfate and concentrated under vacuum. To the resulting residue, 150 ml of acetone and 3.3 g of compound (b) were added and the mixture was stirred at room temperature for 4 h. Following the addition of water, the mixture was extracted with ethyl acetate and the organic layer was washed successively with an aqueous solution of 5% $NaHCO_3$, dilute HCl and $H_2O$. The organic layer was dried and concentrated. The residue was purified by chromatography on silica gel column with ethyl acetate/hexane being used as a developing solvent to yield intermediate (c) in an amount of 8.4 g.

(II) Synthesis of exemplary compound (25)

Intermediate (c) (4.0 g) was added to 80 ml of acetic acid. To the mixture, 3.0 g of a zinc powder was added and stirred for 20 min. The solids content was recovered by filtration, concentrated under vacuum and extracted with ethyl acetate. The organic layer was washed with an aqueous solution of 5% $NaHCO_3$, dried on magnesium sulfate and concentrated under vacuum.

To the residue, 80 ml of ethyl acetate and 0.6 g of succinic anhydride were added and the mixture was subjected to continued heating at reflux temperature under stirring for 3 h. Subsequently, ethyl acetate was distilled off under vacuum and the residue was purified by chromatography on silica gel column with toluene-/acetone being used as a developing solvent to yield exemplary compound (25) in an amount of 2.6 g.

The structural identity of this compound was verified by NMR and mass spectra.

The silver halide color photographic material containing the compound (I) may be processed by color development, bleaching, fixing and any other procedures that are adopted with ordinary reversal color photographic materials. If desired, the thus processed photographic material may be subjected to image amplification using a transition metal complex (e.g. cobalt hexamine) as described in U.S. Pat. Nos. 3,674,490, 3,822,129, 3,834,907, 3,841,873, 3,847,619, 3,862,842, 3,902,985 and 3,923,511 or an oxidizer such as a peroxide (e.g. hydrogen peroxide).

The silver halide color photographic material containing the compound (I) may have a single silver halide emulsion or more than one silver halide emulsion layer on a base.

A multilayered color photographic material usually has at least one each of a red-sensitive emulsion layer, a green-sensitive emulsion layer and a blue-sensitive emulsion layer on a base. The order of these layers is not critical and may be altered as required. Usually, a cyan-forming coupler is incorporated in the red-sensitive emulsion layer, a magenta-forming coupler in the green-sensitive emulsion layer, and a yellow-forming coupler in the blue-sensitive emulsion layer; however, this is not the sole case of the present invention and other combinations of couplers and emulsion layers may be adopted.

The silver halide photographic material of the present invention is also applicable to black-and-white photography and in this case, the material is composed of a base carrying a single layer that incorporates a black dye image forming coupler.

The compound (I) may be incorporated in any one of the light-sensitive silver halide emulsion layers in those silver halide color photographic materials, or it may be incorporated in layers adjacent to those emulsion layers. If desired, the compound may be incorporated in more than one of the constituent layers of the photographic material.

When the compound (I) is added to the silver halide color photographic material, its amount varies from about 0.01 to about 3 moles per mole of silver halide.

The compound (I) can be incorporated in the silver halide color photographic material of the present invention by various methods and typical examples of applicable methods are described below:

(A) The compound (I) is dissolved in a high-boiling organic solvent that is slightly soluble in water and the resulting solution is dispersed in an aqueous medium, followed by addition to an emulsion of interest;

(B) The compound (I) is dissolved in a low-boiling organic solvent that has comparatively low solubility in water, and the resulting solution is dispersed in an aqueous medium, followed by addition to an emulsion of interest (the organic solvent used is removed in the process of preparing the light-sensitive material); and (C) The compound (I) is dissolved in an organic solvent that is highly miscible with water and the resulting solution is added to a photographic emulsion of interest, whereupon the compound is dispersed as fine colloid particles.

Depending on the solubility of the compound (I), the solvents mentioned under (A), (B) and (C) may be used as admixtures or, alternatively, a dispersion aid may be used.

If the timing group having a photographically useful group bound thereto or the photographically useful group per se is diffusible, a layer or a unit layer that are subject to the effect of that photographically useful group may be controlled by interposing one or more scavenger layers at appropriate positions in constituent layers of the silver halide photographic material.

Silver halides to be used in the silver halide photographic material of the present invention can be prepared by conventional methods and they have any compositions including silver chloride, silver bromide. silver chlorobromide, silver iodobromide and silver chloroiodobromide. Emulsions of these silver halides can be prepared in the usual manner and they may optionally be chemically sensitized.

Hence, silver halide emulsions to be used in the present invention may be mono- or polydispersed. Silver halide grains may be of any size or shape. The emulsions to be used may be negative- or positive acting, or they may be of an internal latent image type or a surface latent image type.

If emulsions are to be chemically sensitized, known chemical sensitizers may be used. If desired, the emulsions may contain commonly employed additives such as a sensitizing dye, an antifoggant, a hardener, a plasticizer and a surfactant.

For detailed information about silver halide emulsions and applicable additives, see "Research Disclosure", 9232, December, 1971.

In accordance with the action and properties of the photographically useful group it contains, the compound (I) may be added to the silver halide photographic material depending upon the specific object to be attained and the layout of constituent layers in the photographic material. If necessary, various couplers or other additives may be used in combination with the compound (I). If the photographically useful group to be released from the compound (I) is a development inhibitor, it may be used in those silver halide photographic materials which are described in U.S. Pat. Nos. 3,227,554, 3,620,747 and 3,703,375.

The following examples are provided for the purpose of further illustrating the present invention but are in no way to be taken as limiting.

EXAMPLE 1

In Example 1 and subsequent examples, the amounts of additions to silver halide photographic materials are those per square meter unless otherwise noted; the contents of silver halides are expressed in terms of silver whereas the contents of sensitizing dyes and couplers are expressed in moles per mole of silver in the same layer.

Layers having the compositions listed below were successively formed on a triacetyl cellulose film base (the first layer being the closest to the base) to prepare a multi-layered color photographic material (sample 1).

| Sample 1 (comparison) | |
|---|---|
| First layer: Anti-halo layer (HC) | |
| Gelatin layer containing black colloidal silver | |
| Dry film thickness | 3 μm |
| Second layer: Intermediate layer (IL) | |
| Gelatin layer containing an emulsified dispersion of 2,5-di-t-octylhydroquinone | |
| Dry film thickness | 1.0 μm |
| Third layer: Less red-sensitive silver halide emulsion layer (RL) | |
| Monodispersed emulsion made of AgBrI having an average grain size of 0.3 μm and containing 3 mol % AgI (Emulsion I: 12% spread of distribution) | 1.8 g |
| Sensitizing dye I | $6.0 \times 10^{-4}$ mole |
| Sensitizing dye II | $1.0 \times 10^{-4}$ mole |
| Cyan coupler (C-1) | 0.06 mole |
| Colored cyan coupler (CC-1) | 0.003 mole |
| DIR compound (D-1) | 0.0015 mole |
| DIR compound (D-2) | 0.002 mole |
| Dioctyl phthalate | 0.6 g |
| Dry film thickness | 3.5 μm |
| Fourth layer: Highly red-sensitive silver halide emulsion layer (RH) | |
| Monodispersed emulsion made of AgBrI having an average grain size of 0.5 μm and containing 3 mol % AgI (Emulsion II: 12% spread of distribution) | 1.3 g |
| Sensitizing dye I | $3.0 \times 10^{-4}$ mole |
| Sensitizing dye II | $1.0 \times 10^{-4}$ mole |
| Cyan coupler (C-1) | 0.02 mole |
| Colored cyan coupler (CC-1) | 0.0015 mole |
| DIR compound (D-2) | 0.001 mole |
| Dioctyl phthalate | 0.2 g |
| Dry film thickness | 2.5 μm |
| Fifth layer: Intermediate layer (IL) | |
| Same gelatin layer as the second layer | |
| Dry film thickness | 1.0 μm |
| Sixth layer: Less green-sensitive silver halide emulsion layer (GL) | |
| Emulsion I | 1.5 g |
| Sensitizing dye III | $2.5 \times 10^{-4}$ mole |
| Sensitizing dye IV | $1.2 \times 10^{-4}$ mole |
| Magenta coulpler (M-1) | 0.10 mole |
| Colored magenta coupler (CM-1) | 0.009 mole |
| DIR compound (D-1) | 0.0010 mole |
| DIR compound (D-3) | 0.0030 mole |
| Tricresyl phosphate | 0.5 g |
| Dry film thickness | 3.5 μm |
| Seventh layer: Highly green-sensitive silver halide emulsion layer (GH) | |

-continued

| Sample 1 (comparison) | |
|---|---|
| Emulsion II | 1.4 g |
| Sensitizing dye III | $1.5 \times 10^{-4}$ mole |
| Sensitizing dye IV | $1.0 \times 10^{-4}$ mole |
| Magenta coupler (M-1) | 0.025 mole |
| Colored magenta coupler (CM-1) | 0.002 mole |
| DIR compound (D-3) | 0.0010 mole |
| Tricresyl phosphate | 0.3 g |
| Dry film thickness | 2.5 μm |
| Eighth layer: Yellow filter layer (YC) | |
| Gelatin layer containing yellow colloidal silver and an emulsified dispersion of 2,5-di-t-octyl hydroquinone | |
| Dry film thickness | 1.2 μm |
| Ninth layer: Less blue-sensitive silver halide emulsion layer (BL) | |
| Monodispersed emulsion made of AgBrI having an average grain size of 0.48 μm and containing 3 mol % AgI (Emulsion III: 12% spread of distribution) | 0.9 g |
| Sensitizing dye V | $1.3 \times 10^{-4}$ mole |
| Yellow coupler (Y-1) | 0.29 mole |
| Tricresyl phosphate | 0.5 mole |
| Dry film thickness | 3.5 μm |
| Tenth layer: Highly blue-sensitive silver halide emulsion layer (BH) | |
| Monodispersed emulsion made of AgBrI having an average grain size of 0.8 μm and containing 3 mol % AgI (Emulsion IV: 12% spread of distribution) | 0.5 g |
| Sensitizing dye V | $1.0 \times 10^{-4}$ mole |
| Yellow coupler (Y-1) | 0.08 mole |
| DIR compound (D-2) | 0.0015 mole |

-continued

| Sample 1 (comparison) | |
|---|---|
| Tricresyl phosphate | 0.10 mole |
| Dry film thickness | 2.5 μm |
| Eleventh layer: First protective layer (PRO-1) | |
| AgBrI emulsion (12 mol % AgI; average grain size, 0.07 μm) | 0.5 g |
| Gelatin layer containing uv absorbers (UV-1) and (UV-2) | |
| Dry film thickness | 2.0 μm |
| Twelfth layer: Second protective layer (PRO-2) | |
| Gelatin layer containing polymethyl methacrylate particles (dia. 1.5 μm) and formaldehyde scavenger (HS-1) | |
| Dry film thickness | 1.5 μm |

Besides the ingredients set forth above, a gelatin hardner (H-1) and a surfactant were also added, as required, to the respective layers.

Sensitizing dye I: Anhydro-5,5'-dichloro-9-ethyl-3,3'-di-(3-sulfopropyl) thiacarbocyanine hydroxide Sensitizing dye II: Anhydro-9 -ethyl-3,3'-di-(3-sulfopropyl) 4,5,4',5'-dibenzothiacarbocyanine hydroxide Sensitizing dye III: Anhydro-5,5'-diphenyl-9-ethyl-3,3'-di-(3-sulfopropyl) oxacarbocyanine hydroxide Sensitizing dye IV: Anhydro-9 -ethyl-3,3'-di-(3-sulfopropyl) 5,6,5',6'-dibenzoxacarbocyanine hydroxide Sensitizing dye V: Anhydro-3,3'-di-(2-sulfopropyl)-4,5-benzo-5'-methoxythiacyanine hydroxide

C-1

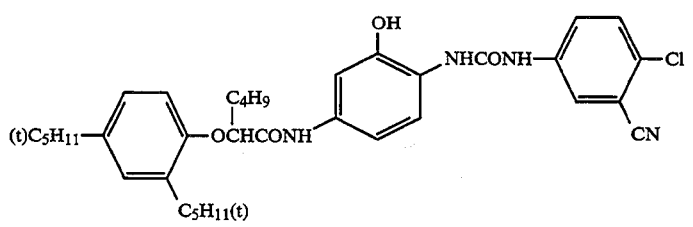

CC-1

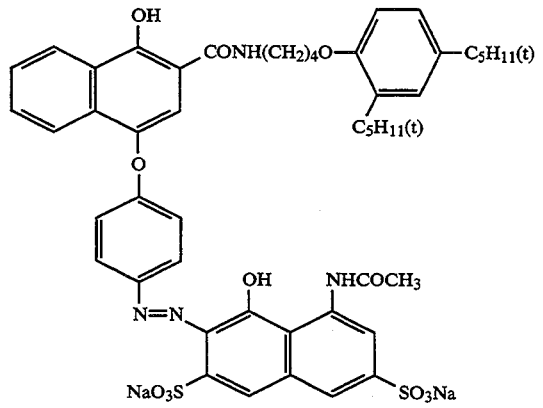

-continued
D-1
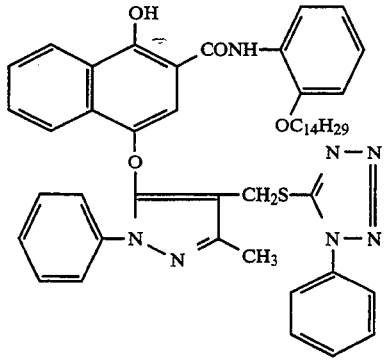
D-2
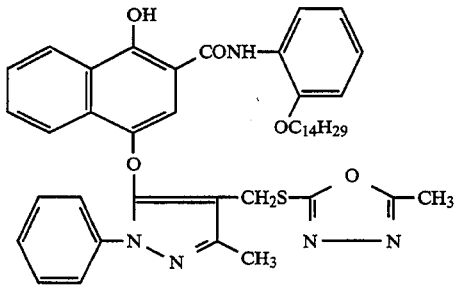
D-3
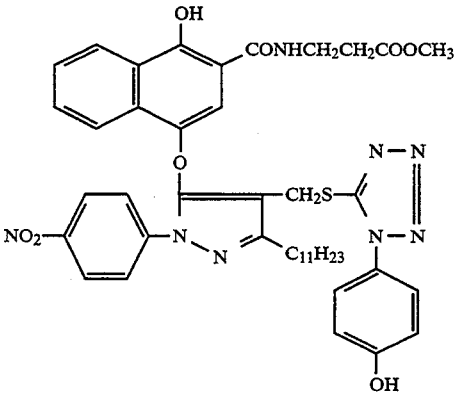
D-4
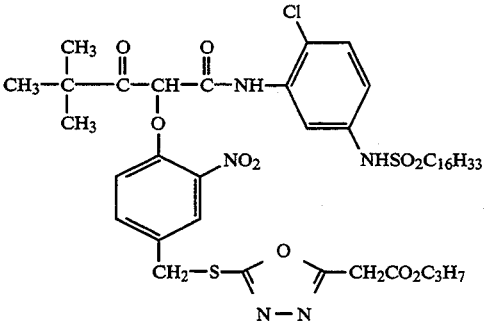

-continued
D-5
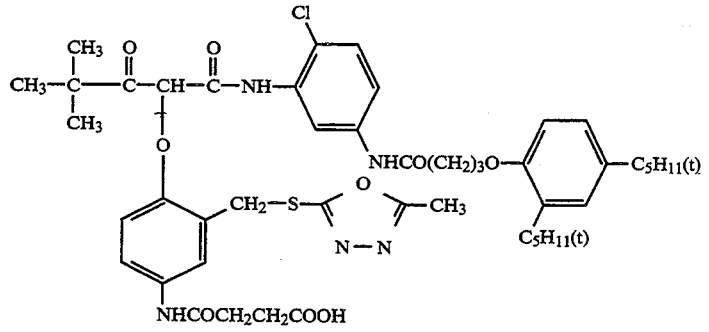
CM-1
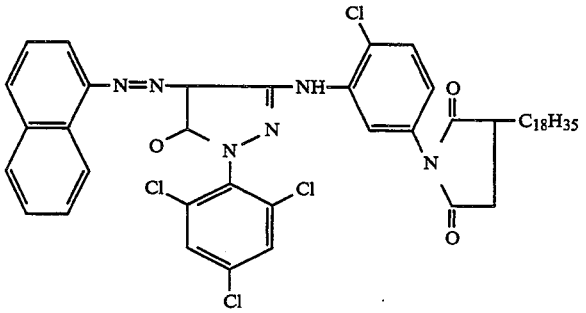
M-1
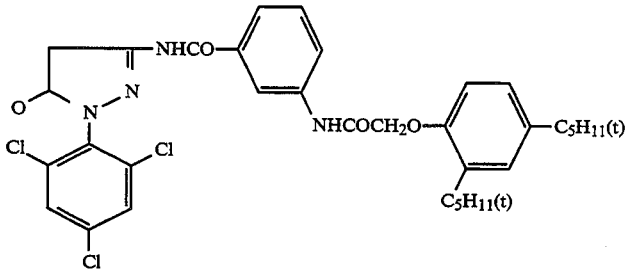
Y-1
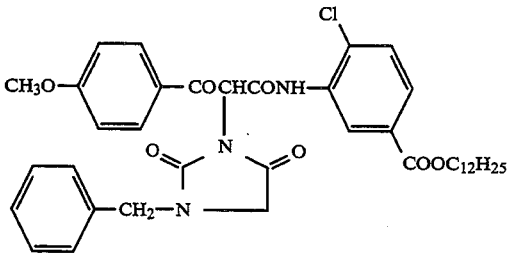
UV-1
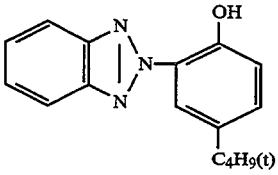
UV-2
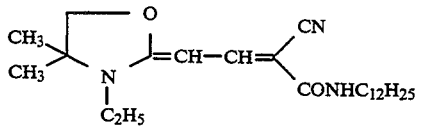
HS-1
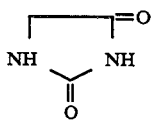

-continued

H-1

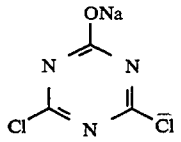

Samples 2–8 were prepared by repeating the procedure for preparing sample 1 except that the DIR compound (D-2) added to layer 10 was replaced by compounds whose names and amounts are listed in Table 1.

The photographic materials thus prepared (samples 1–8) were exposed through an optical wedge by a conventional method and subsequently processed by the following scheme.

| Processing scheme (38° C.) | Time |
|---|---|
| Color development | 3 min and 15 sec |
| Bleaching | 6 min and 30 sec |
| Washing with water | 3 min and 15 sec |
| Fixing | 6 min and 30 sec |
| Washing with water | 3 min and 15 sec |
| Stabilizing | 1 min and 30 sec |
| Color developing solution | |
| 4-Amino-3-methyl-N-ethyl-N-(β-hydroxyethyl) aniline sulfate | 4.75 g |
| Anhydrous sodium sulfite | 4.25 g |
| Hydroxylamine hemisulfate | 2.0 g |
| Anhydrous potassium carbonate | 37.5 g |
| Sodium bromide | 1.3 g |
| Nitrilotriacetic acid trisodium salt (monohydrate) | 2.5 g |
| Potassium hydroxide | 1.0 g |
| Water | to make 1,000 ml |
| pH | adjusted to 10.0 |
| Bleaching solution | |
| Ethylenediaminetetraacetic acid iron (III) ammonium salt | 100 g |
| Ethylenediaminetetraacetic acid diammonium salt | 10.0 g |
| Ammonium bromide | 150.0 g |
| Glacial acetic acid | 10.0 g |
| Water | to make 1,000 ml |
| pH | adjusted to 6.0 |
| Fixing solution | |
| Ammonium thiosulfate (50% aq. sol.) | 162 ml |
| Anhydrous sodium sulfite | 12.4 g |
| Water | to make 1,000 ml |
| pH | adjusted to 6.5 |
| Stabilizing solution | |
| Formaldehyde (37% aq. sol.) | 5.0 ml |
| Konidax (Konica Corp.) | 7.5 ml |
| Water | to make 1,000 ml |

The processed samples were measured for their transmission density with an X-rite Desitometer Model 310 through a status M filter and a D vs −logE characteristic curve was constructed for each sample. Using the characteristic curve of blue density (B) measured for each sample, the following three gradients were determined; $\gamma_1$, or the slope of the straight line connecting the point at density 1.5 and the point of density for higher exposure by $\Delta\log E=1.0$; $\gamma_2$, or the slope of the straight line connecting the point at density 2.0. and the point of density for higher exposure by $\Delta\log E=1.0$; $\gamma_3$, or the slope of the straight line connecting the point at density 2.5 and the point of density for higher exposure by $\Delta\log E=1.0$. The data obtained are shown in Table 1.

The relative (specific) sensitivity of each sample was evaluated, with the value for sample 1 being taken as 100, and the results are also shown in Table 1.

TABLE 1

| Sample | DIR compound in tenth layer: Identification | Amount (mol/mol AgI) | Specific sensitivity | $\gamma_1$ | $\gamma_2$ | $\gamma_3$ |
|---|---|---|---|---|---|---|
| Comparison | | | | | | |
| 1 | D-2 | 0.0015 | 100 | 0.70 | 0.68 | 0.57 |
| 2 | D-1 | 0.0011 | 92 | 0.68 | 0.68 | 0.61 |
| 3 | D-4 | 0.0075 | 101 | 0.68 | 0.71 | 0.60 |
| 4 | D-5 | 0.0090 | 98 | 0.69 | 0.70 | 0.61 |
| Invention | | | | | | |
| 5 | (1) | 0.0120 | 112 | 0.69 | 0.69 | 0.66 |
| 6 | (4) | 0.0090 | 108 | 0.68 | 0.69 | 0.65 |
| 7 | (12) | 0.0120 | 110 | 0.70 | 0.69 | 0.67 |
| 8 | (25) | 0.0120 | 114 | 0.70 | 0.71 | 0.66 |

As is clear from the data shown in Table 1, comparative samples 1–4 did not have good linearity in gradation from the low to high exposure range of the characteristic curve. In contrast, samples 5–8 of the present invention had a smooth linear gradation as evidenced by almost equal values of $\gamma_1$, $\gamma_2$ and $\gamma_3$. It was also clear that the samples of the present invention had higher sensitivities than the comparative samples when compared at substantially same levels of $\gamma$.

As one can see from the foregoing description, the silver halide color photographic material of the present invention suffers from only limited desensitization (even in the low-exposure range) and insures smooth (linear) gradation from the low to high exposure range. Thus, the photographic material of the present invention has a wide latitude (the range of appropriate exposure), is capable of recording more image information in an amount corresponding correctly to the quantity of exposing light (image can be recorded even if the quantity of light is somewhat deviated from the appropriate exposure), and suffers from less desensitization.

What is claimed is:

1. A silver halide color photographic material that contains at least one compound represented by the following general formula (I):

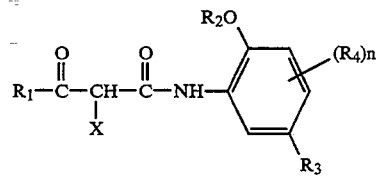

(I)

where $R_1$ is an alkyl group; $R_2$ is an alkyl or aryl group; $R_3$ is an oxycarbonyl, sulfonamido, carbamoyl, acylamino, ureido, oxycarbonylamino, sulfonyloxy, carbonyloxy or sulfamoyl group; $R_4$ is a substituent; n is 0, 1, 2 or 3; and X is a group which, when eliminated upon coupling with the oxidation product of a developing agent, forms an ortho-quinonemethide or para-quinonemethide to release a development inhibitor or a precursor thereof.

2. A silver halide color photographic material according to claim 1 wherein X is represented by the following general formula (II) or (III):

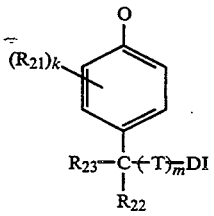

(II)

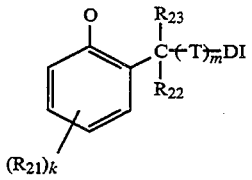

(III)

where $R_{21}$ is a group that can be substituted on the benzene ring; $R_{22}$ and $R_{23}$ are each a hydrogen atom, an alkyl group or an aryl group; T is a linkage group; DI is a development inhibitor; k is an integer of 0–4; and m is 0 or 1.

3. A silver halide color photographic material according to claim 1 wherein the compound represented by the general formula (I) is contained in a light-sensitive silver halide emulsion layer or a layer adjacent thereto.

4. A silver halide color photographic material according to claim 1 wherein the compound represented by the general formula (I) is contained in an amount of 0.01–3 moles per mole of silver halide.

5. A silver halide photographic material according to claim 1, wherein $R_4$ is a substituent selected from the group consisting of a halogen atom, an alkyl group, an alkoxy group, an aryloxy group, an acyloxy group, an imido group, an acylamino group, a sulfonamido group, an oxycarbonyl group, a carbamoyl group, a sulfamoyl group, a carbonyloxy group, an oxycarbonylamino group, a ureido group, and a sulfonyloxy group.

* * * * *